US006826813B2

(12) United States Patent
Koslowski et al.

(10) Patent No.: US 6,826,813 B2
(45) Date of Patent: Dec. 7, 2004

(54) METHOD AND APPARATUS FOR STUFFER BOX CRIMPING AN ADVANCING MULTIFILAMENT YARN

(75) Inventors: Gerhard Koslowski, Remscheid (DE); Klaus Schafer, Remscheid (DE)

(73) Assignee: Saurer GmbH & Co. KG, Mönchengladbach (DE)

( * ) Notice: Subject to any disclaimer, the term of this patent is extended or adjusted under 35 U.S.C. 154(b) by 211 days.

(21) Appl. No.: 10/233,736

(22) Filed: Sep. 3, 2002

(65) Prior Publication Data

US 2004/0031134 A1 Feb. 19, 2004

Related U.S. Application Data

(63) Continuation of application No. PCT/EP01/01993, filed on Feb. 22, 2001.

(30) Foreign Application Priority Data

Mar. 1, 2000 (DE) ..... 100 09 988

(51) Int. Cl.[7] ..... D02G 1/12
(52) U.S. Cl. ..... 28/263; 28/267; 28/268
(58) Field of Search ..... 28/263, 265, 266, 28/267, 268, 271, 273, 274, 276, 262, 258, 254–257, 250

(56) References Cited

U.S. PATENT DOCUMENTS

| | | | | |
|---|---|---|---|---|
| 3,576,058 A | | 4/1971 | Berg et al. | |
| 3,810,285 A | | 5/1974 | Ferrier et al. | |
| 3,832,759 A | | 9/1974 | Eskridge et al. | |
| 4,040,153 A | * | 8/1977 | Hatcher et al. | 28/255 |
| 4,041,586 A | | 8/1977 | Foster et al. | |
| 4,124,924 A | * | 11/1978 | Phillips et al. | 28/220 |
| 4,148,179 A | * | 4/1979 | Becker et al. | 57/350 |
| 4,188,691 A | * | 2/1980 | Matsumoto et al. | 28/255 |
| 4,268,940 A | | 5/1981 | Kuroda et al. | |
| 4,829,640 A | * | 5/1989 | Greb et al. | 28/255 |
| 4,956,901 A | * | 9/1990 | Koskol et al. | 28/255 |
| 5,088,168 A | * | 2/1992 | Berger et al. | 28/249 |
| 5,579,566 A | | 12/1996 | Burkhardt et al. | |
| 5,732,454 A | | 3/1998 | Busenhart et al. | |
| 6,141,843 A | | 11/2000 | Hegenbarth et al. | |
| 6,253,431 B1 | * | 7/2001 | Ames et al. | 28/283 |

FOREIGN PATENT DOCUMENTS

| | | |
|---|---|---|
| DE | 20 30 229 | 12/1971 |
| DE | 21 16 274 | 12/1971 |
| DE | 26 32 083 | 1/1978 |
| EP | 0 539 808 A1 | 5/1993 |
| EP | 0 761 855 A1 | 3/1997 |
| FR | 2 280 727 | 2/1976 |
| GB | 1 538 405 | 1/1979 |
| WO | WO 95/16065 | 6/1995 |

* cited by examiner

*Primary Examiner*—A. Vanatta
(74) *Attorney, Agent, or Firm*—Alston & Bird LLP

(57) ABSTRACT

A method and an apparatus for stuffer box crimping a multifilament yarn, wherein the yarn is conveyed into a crimping device in two steps. In the first step, the yarn is taken in by a conveying fluid stream of a first feed nozzle at a yarn intake speed. In the second step the yarn is advanced by a conveying fluid stream of a second feed nozzle at a second yarn conveying speed into the crimping device. In this process, the second yarn conveying speed is at least the same as or greater than the intake speed.

19 Claims, 3 Drawing Sheets

METHOD AND APPARATUS FOR STUFFER BOX CRIMPING AN ADVANCING MULTIFILAMENT YARN

CROSS REFERENCE TO RELATED APPLICATION

This is a continuation of copending application PCT/EP01/01993, filed Feb. 22, 2001 which designates the U.S.

BACKGROUND OF THE INVENTION

The invention relates to a method and apparatus for stuffer box crimping a multifilament yarn of the general type disclosed in EP 0 539 808 B1 and corresponding U.S. Pat. No. 5,579,566.

In conventional stuffer box crimping operations, a multifilament synthetic endless yarn is advanced into a crimping device by means of a feed nozzle. To this end, the feed nozzle comprises an injector, which introduces a pressurized fluid into a conveying channel of the feed nozzle. The crimp effect is based on heating the yarn with the use of a heated conveying medium, compacting it in a stuffer box downstream of the feed nozzle, and forming a plug thereof. The heated conveying medium is able to escape through slots provided in the wall of the stuffer box. The yarn plug is removed from the stuffer box, at a defined speed, by a delivery roll downstream of the crimping device, and subsequently cooled.

The use of the flow channel of the feed nozzle, which is disclosed in EP 0 539 808 B1 and constructed as a Laval nozzle, enables stuffer box crimping methods with yarn supply speeds as high as 4000 m/min. In particular, this increase is realized without raising the pressure of the conveying medium.

A further increase of the yarn speed requires a higher pressure of the conveying medium, since otherwise the yarn tension that is built up in the conveying nozzle will not suffice to reliably draw the yarn into the crimping device. An increased pressure of the conveying medium, however, results on the other hand in that the yarn plug is blown out of the stuffer box, since the frictional forces between the yarn plug and the stuffer box wall will no longer be adequate. Moreover, in the case of high speeds and in particular in the case of low deniers, it is no longer possible to use the feed roll downstream of the crimping device because of the risk of lap formation.

DE 21 16 274 B2 and corresponding U.S. Pat. No. 3,810,285 disclose a further device, wherein a feed nozzle and a crimping device cooperate. To this end, the conveying channel is provided directly upstream of the inlet to the stuffer box of the crimping device with a relief zone, in which the conveying fluid flowing within the conveying channel is able to expand. In this process, the yarn is bulked by loosening the filament bundle. Thus, the known device has the disadvantage that at higher yarn speeds and, with that, at higher fluid pressures, the expanded filament bundle gets hung up in the transitional region between the relief chamber and the last section of the yarn channel. As a result, an unwanted yarn plug forms in the relief chamber. A further disadvantage of the known device lies in that the yarn is deposited in the stuffer box only as a function of the conveying fluid that is carried along in the last portion of the yarn channel. A defined conveyance of the yarn into the stuffer box does not occur.

It is therefore an object of the invention to further develop the method and apparatus of the described type for stuffer box crimping a multifilament yarn such that on the one hand high yarn speeds are made possible, and that on the other hand a yarn can be produced with a high and stable crimp.

SUMMARY OF THE INVENTION

The above and other objects and advantages of the invention are achieved by the provision of a method and apparatus wherein the yarn is advanced to the crimping device in two successive conveying steps. The first conveying step is designed such that the yarn is drawn into the device at a high yarn speed. In the first step, the yarn speed is referred to as the intake speed. In the second conveying step, which immediately follows the first conveying step, the yarn already advancing at a high speed is fed into the crimping device at a conveying speed. In this process, the conveying speed in the second step is at least the same as, or greater than the intake speed of the first step. This ensures that the tension in the yarn does not fall below a minimum, so that the filament bundle remains closed between the two steps.

A further advantage of the invention lies in that the delivery of the yarn into the stuffer box can be substantially directed only to the requirements of the plug formation. The intake of the yarn for building up high yarn speeds is produced by the conveying fluid stream in the first step.

The method of the present invention is especially suitable for very high yarn speeds, with the intake speed being at least about 3,000 m/min., preferably at least about 4,000 m/min. In this process, it is preferred to withdraw the yarn from a spin zone by means of a draw system, and that after being drawn, the yarn is received by the conveying nozzle of the first step. However, it is also possible to withdraw the yarn from a feed yarn package. Regardless of the way of making the yarn available, the intake speed of the yarn in the first step needs to be directed toward the end that an adequate tension of the advancing yarn does not fall below, for example, 10 cN.

To be able to perform process variations, which are needed, for example, because of different polyester materials, the first conveying fluid stream in the first step and the second conveying fluid stream in the second step are controlled independently of each other. This permits making fine adjustments both for building up a yarn tension in the upstream yarn path and for the crimp formation in the stuffer box.

To produce the conveying fluid streams, the conveying fluid of the first step is maintained under a pressure from at least about 2 bars to at most about 15 bars, preferably from at least 4 bars to at most 12 bars. In comparison therewith the pressure of the conveying fluid for producing the second conveying stream is adjusted to a small range from at least about 1 bar to at most about 8 bars, preferably from at least 2 bars to at most 6 bars. In general, however, it is essential that the pressure of the conveying fluid in the first step assume a greater value than the pressure of the conveying fluid in the second step. In this instance, the exact adjustment values are likewise dependent on the foregoing parameters, such as, for example, the type of polymer, yarn tension, crimp formation, etc.

In an especially advantageous further development of the invention, the conveying fluid for the first conveying fluid stream and for the second conveying fluid stream is introduced by a common injector. To this end, an expansion chamber is formed between the feed nozzles, in which the outlet of the conveying channel of the first feed nozzle and the inlet of the conveying channel of the second feed nozzle terminate. The expansion chamber connects to a controllable throttle valve, so that it is possible to discharge a portion of the first conveying fluid stream that enters the expansion chamber. Thus, the portion of the first conveying stream that remains within the expansion chamber, is used for producing the second conveying fluid stream in the subsequent conveying channel. The controllable throttle valve permits adjusting the discharged conveying fluid stream.

In tests that were performed by the method of the present invention, it was possible to realize in the case of a predrawn polyester yarn of the specification 167f46 and 83f36, at yarn delivery speeds of 5,100 m/min., a crimp of 25% and a crimp stability of 85% with a yarn tension of 4 cN/dtex. The values for crimp and crimp stability were determined in accordance with DIN [German Industrial Standards] 53 840 Part 1.

In the case of a predrawn polyamide yarn of the specification 83f34, it was possible to realize at yarn delivery speeds of 4,500 m/min., a crimp of 20% and a crimp stability of 90% with a yarn tension of 4 cN/dtex.

Particularly suitable as a conveying fluid medium is hot air. It showed that the crimp of the yarn becomes greater as the hot air temperature increases. An upper limit of 180° C. was found for polyester and 240° C. for polyamide.

Still better crimp values are obtained with overheated, if possible, dry vapor.

To ensure a reliable plug formation in the stuffer box even at the high yarn speeds, it is advantageous to discharge the conveying fluid stream by means of a vacuum through openings in the front region of the stuffer box.

At the beginning of the process, it is possible to introduce at times a fluid through an opening in the rear region of the stuffer box against the direction of the yarn movement, and to thus exert a braking effect on the yarn, thereby initiating the plug formation in the stuffer box.

To carry out the method, the device of the present invention comprises two feed nozzles, each with a nozzle-shaped conveying channel. Both feed nozzles follow each other in the direction of the advancing yarn such that the outlet of the one conveying channel is directly opposite to the inlet of the second conveying channel. This permits producing through the feed nozzles two conveying fluid streams independently of each other for taking in the yarn in a first step, and transporting it in a second, downstream step into the stuffer box of the crimping device.

In this connection, it is possible that each of the feed nozzles has an injector for introducing one fluid stream each into the associated conveying channels. The injectors can be supplied individually or jointly by a controllable source of pressure. In the case of a joint supply from a source of pressure, means for adjusting the pressure are to be provided separately.

However, it is also possible to interconnect the feed nozzles such that they are jointly supplied by one injector.

In this connection, it will be especially advantageous, when the feed nozzles are interconnected such that an expansion chamber is formed between the conveying channels, with the outlet cross section of the conveying channel terminating in the expansion chamber being greater than the narrowest cross section of the subsequent conveying channel, so that a transportation of the conveying fluid into the subsequent conveying channel remains ensured. In this case, the expansion chamber connects to a controllable throttle valve.

To be able to produce, if possible, a high tension on the yarn as it is taken in, the conveying channel formed in the first feed nozzle, is configured preferably as a Laval nozzle, so that the conveying fluid is able to reach sonic speed in a narrowest cross section of the Laval nozzle. To ensure a uniform jamming of the yarn inside the stuffer box, the conveying channel of the second feed nozzle terminates directly in the stuffer box.

In this connection, it will be especially advantageous, when the outlet of the conveying channel and the inlet of the stuffer box are arranged in a vacuum chamber. The stuffer box connects via opening slots to the vacuum chamber, which is hooked up to a controllable source of vacuum. This further development of the invention offers a further possibility of adjusting the second conveying fluid stream.

For cooling the yarn plug leaving the stuffer box, a cooling drum is arranged preferably downstream of the crimping device. In this arrangement, the yarn plug is guided over the circumference of the cooling drum and cooled by a cooling medium, preferably cooling air.

BRIEF DESCRIPTION OF THE DRAWINGS

In the following, an embodiment is described in greater detail with reference to the attached drawing, in which.

DETAILED DESCRIPTION OF THE PREFERRED EMBODIMENTS

Figure 1:
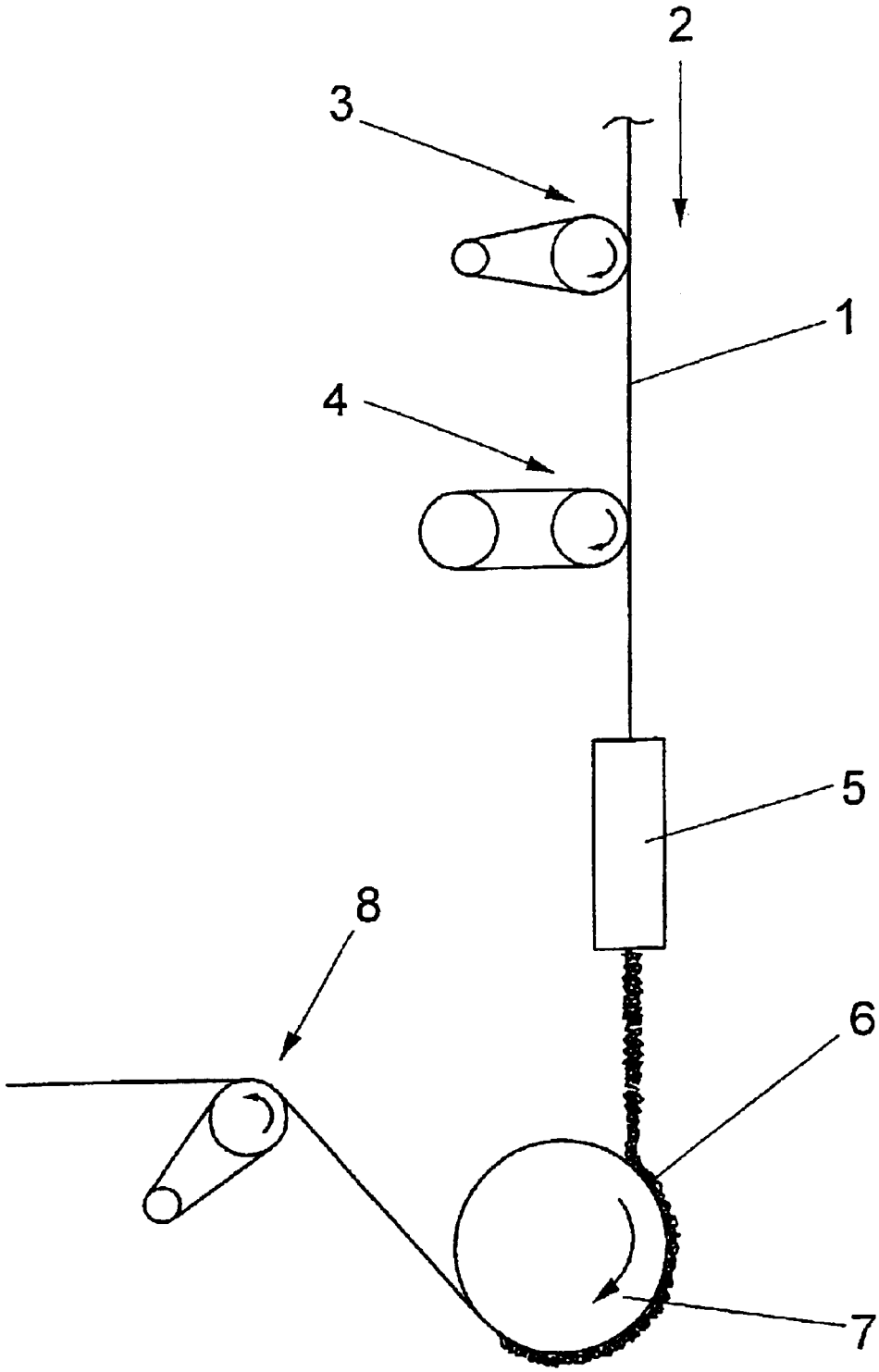
FIG. 1 shows an arrangement with a device according to the invention for carrying out the method of the invention.

FIG. 1 is a schematic view of an arrangement with a device according to the invention for carrying out the method of the invention. In this embodiment, a yarn 1 is fed in the direction of advance 2. The yarn 1 can be supplied directly from a spinning device or from a feed yarn package. When viewed in the direction of the advancing yarn, the arrangement comprises a first godet unit 3, a subsequent pair of godets 4, as well as a stuffer box crimping device 5. The stuffer box crimping device 5 is followed by a cooling drum 7. A further godet unit 8 is provided in the yarn path downstream of the cooling drum 7.

In the illustrated arrangement, the godet unit 3, which consists of a driven godet and a guide roll, withdraws the yarn 1 from a spinning device or a feed yarn package. The yarn 1 is drawn between the godet unit 3 and the pair of godets 4, which is formed by two driven godets. Preferably, at least one of the godets is heated. Subsequently, the yarn 1 is taken into the stuffer box crimping device 5, advanced, and formed to a yarn plug 6. In the crimping device, the yarn is crimped to the yarn plug 6 while being exposed to hot air or vapor, and while forming loops. The yarn plug is then cooled in a cooling zone, which is a cooling drum in the present embodiment. In this process, the crimp is set. The godet unit 8 withdraws the yarn from the cooling drum 7. In so doing, the yarn plug 6 is again disentangled, while maintaining, however, the crimp of the filaments.

Figure 2:
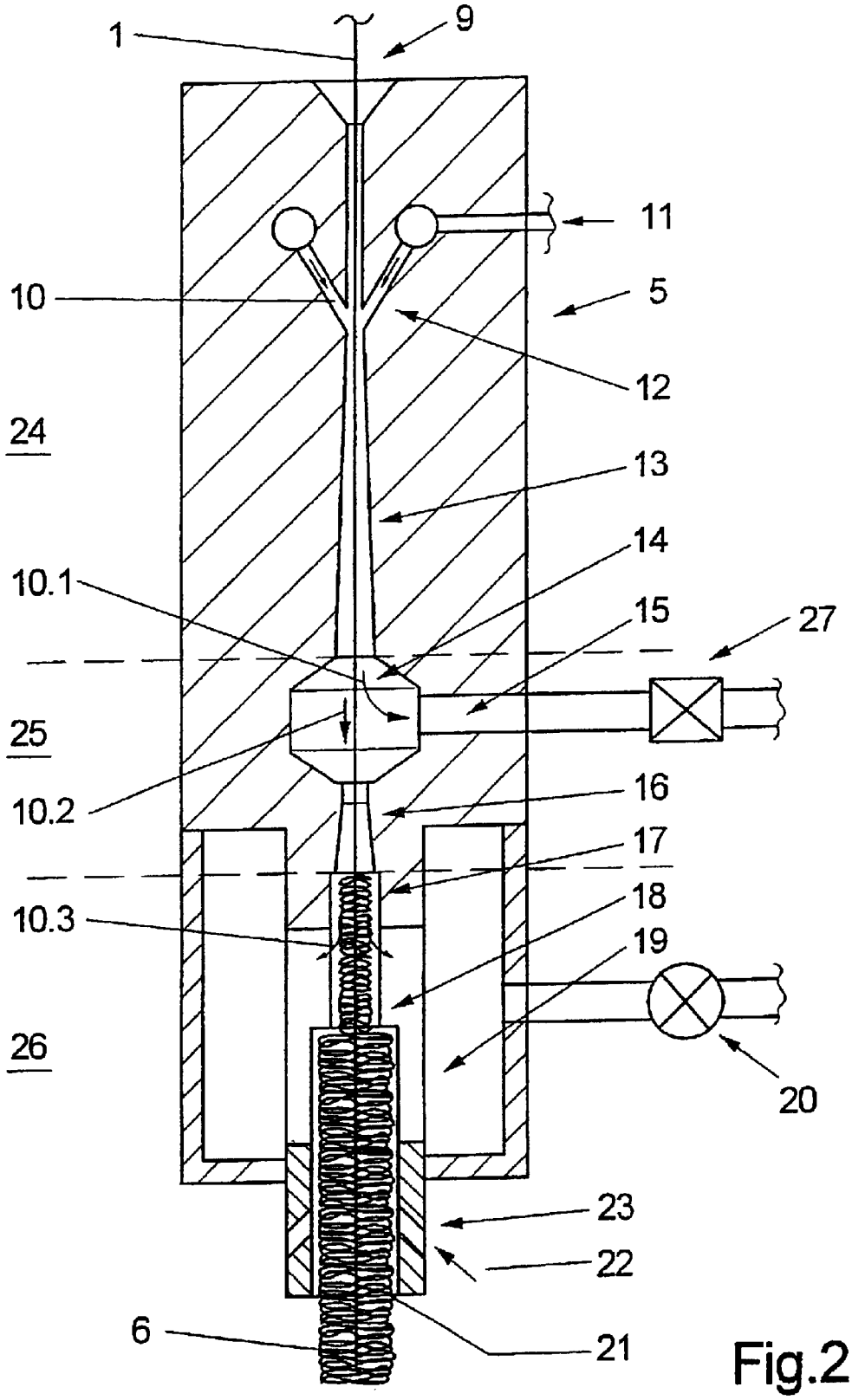
FIG. 2 is a sectional view of a first embodiment of a device for carrying out the method of the invention.

A first embodiment of the stuffer box crimping device as schematically shown in FIG. 1, is illustrated in a schematic sectional view in FIG. 2. The stuffer box crimping device 5 comprises a first feed nozzle 24, a second feed nozzle 25, and a crimping device 26. The feed nozzles 24 and 25, as well as the crimping device 26 are combined to one structural part. The feed nozzle 24 includes a nozzle-shaped conveying channel 13, which connects on its upper side to a yarn inlet 9 and on its underside to an expansion chamber 14. Preferably, the conveying channel 13 is designed and constructed as a Laval nozzle. In the inlet region of conveying channel 13, the feed nozzle 24 includes an injector 12, which connects, via a supply line 11 to a source of pressure not shown. The injector 12 terminates in conveying channel 13 with a plurality of injector bores.

Directly downstream of the first feed nozzle 24 is the second feed nozzle 25. The feed nozzle 25 comprises a conveying channel 16, which terminates on its upper side in expansion chamber 14, and connects on its underside to a stuffer box 17 of crimping device 26. Between the conveying channel 13 of the first feed nozzle 24 and the conveying channel 16 of the second feed nozzle 25, the expansion chamber 14 extends, which is coupled with a throttle valve 27 via a relief channel 15.

Downstream of the second feed nozzle 25 is the crimping device 26, which comprises a stuffer box 17. In its upper region, the stuffer box 17 is surrounded by a vacuum chamber 19, which connects to a source of vacuum 20. The stuffer box 17 and vacuum chamber 19 are interconnected via a plurality of slot-shaped openings 18. To this end, the slot-shaped openings 18 are arranged in the cylindrical wall of stuffer box 17 in the region of vacuum chamber 19. Outside of the vacuum chamber 19, an outlet opening 21 of the stuffer box 17 is formed.

In the device illustrated in FIG. 2, the yarn 1 is drawn at an intake speed into the conveying channel 13 through inlet 9. To this end, a conveying fluid 10 is introduced into the conveying channel 13 via a supply line 11. The pressure of the conveying fluid 10 in supply line 11 is rated such that the intake speed of yarn 1 maintains an adequate yarn tension at the yarn inlet 9. Within conveying channel 13, the conveying fluid 10 is formed to a first conveying fluid stream, which advances the yarn 1. The conveying fluid stream and the yarn 1 advance through conveying channel 13, which is designed and constructed as a Laval nozzle in the present embodiment.

In the expansion chamber 14, the conveying fluid stream expands, and the pressure of conveying fluid 10 decreases. In addition, a partial stream of the conveying fluid is discharged through relief channel 15 via throttle valve 27. The amount of partial stream 10.1 is adjustable via throttle valve 27. A remaining partial stream 10.2 is made to a second conveying fluid stream by means of conveying channel 16 of the second feed nozzle 25, which advances the yarn 1 at a conveying speed into the stuffer box 17. In this connection, the pressure in expansion chamber 14 is rated such that the second conveying fluid stream generates a conveying speed of the yarn, which is at least the same as, however preferably greater than the intake speed of the yarn. This produces between the steps a tension in the yarn, which prevents the filament bundle from unraveling prematurely, and thus ensures a reliable, continued transportation of the yarn into the stuffer box 17. While after its exit from conveying channel 16, the main portion of the second conveying fluid stream 10.3 is discharged through opening slots 18, the yarn 1 jams while forming loops, and forms a yarn plug 6. As shown in the present embodiment, the removal the conveying fluid can be assisted by the vacuum chamber 19, from which the conveying fluid is discharged by means of the source of vacuum 20. The yarn plug 6 leaves the crimping device through outlet opening 21 of stuffer box 17.

At the start of the crimping process, it can happen that the yarn 1 is initially not compacted in the stuffer box 17 to form a yarn plug 6. To initiate the compaction, a braking fluid 22 is supplied via an inlet opening 23 into the stuffer box 17 such that the braking fluid 22 exerts a decelerating effect on the yarn 1, and thus initiates the jamming for forming the plug 6.

Figure 3:
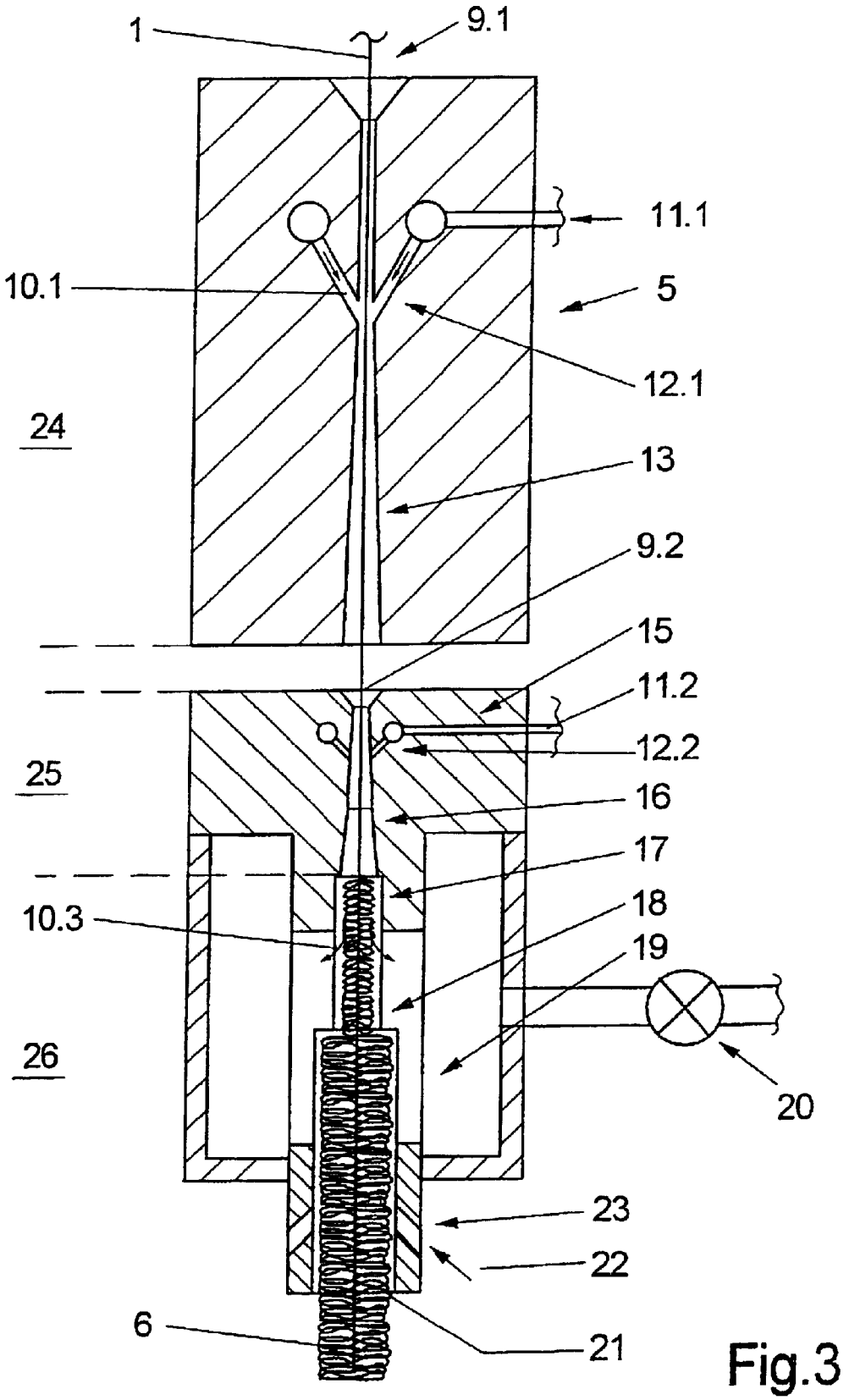
FIG. 3 is a sectional view of a further embodiment for carrying out the method of the invention.

FIG. 3 schematically illustrates a further embodiment of a stuffer box crimping device, as could be used, for example, in the arrangement of FIG. 1. The stuffer box crimping device consists, for example, of a first feed nozzle 24, a second feed nozzle 25, and a crimping device 26. In this embodiment, the feed nozzle 24 is realized as a separate component. The feed nozzle 25 and crimping device 26 are integrated to one component.

In their construction, the feed nozzle 24 and the crimping device 26 are identical with the embodiment of FIG. 2. Insofar, the foregoing description is herewith incorporated by reference.

At a small distance from, or directly downstream of the feed nozzle 24, the second feed nozzle 25 is arranged. The feed nozzle 25 includes a nozzle-shaped conveying channel 16, which connects on its upper side to a yarn inlet 9.2, and on its underside to the stuffer box 17 of crimping device 26. An injector 12.2 is associated with conveying channel 16. The injector 12.2 connects via a supply line 11.2 to a source of pressure not shown. Via the supply line 11.2 and injector 12.2 a conveying fluid under pressure is introduced into conveying channel 16. The conveying fluid is caused to form a conveying fluid stream, which advances the yarn 1 through the conveying channel 16 into the stuffer box 17.

In the embodiment shown in FIG. 3, the conveying fluid stream is formed in feed nozzle 24 by the conveying fluid, which is supplied by injector 12.1 into conveying channel 13. The second conveying fluid stream in feed nozzle 25 is formed by the conveying fluid, which is introduced into the conveying channel 16 by injector 12.2. The operation of the embodiment of the stuffer box crimping device of FIG. 3 is identical with the foregoing embodiment, so that the foregoing description is herewith incorporated by reference.

Both the method of the invention and the device of the invention distinguish themselves in that two conveying fluid streams that can be produced independently of each other are used for taking in the yarn and for conveying it into the stuffer box. It is thus possible to select the pressure of the supplied fluid, while taking the yarn 1 into the stuffer box crimping device, in such a manner that a minimal yarn tension remains intact. In this connection, pressures of as much as 15 bars are possible. Contrary thereto, the fluid for conveying the yarn into the stuffer box is rated in its pressure such that it ensures a reliable plug formation inside the stuffer box. The pressure of the fluid for conveying the yarn is adjusted, preferably to a value from 2 bars to at most 6 bars.

The method of the invention is suitable for all types of polyester. In particular, it is possible to use yarns of polyester, polyamide, or polypropylene. All types of polyester are suitable, such as, for example, PET, PPT, or PTT. By the method of the invention, it has been possible to achieve, for example, from a polyester yarn of the specification 167f46 and 63f36, a crimp of 25% at yarn delivery speeds of 5,100 m/min, and a crimp stability of 65% with a yarn tension of 4 cN/dtex. With that, it is made possible to produce in particular crimped textile yarns directly from freshly spun filaments in one process step.

What is claimed is

1. A method of stuffer box crimping a multifilament yarn comprising the steps of advancing the yarn and a conveying fluid stream into a crimping device in which the yarn is compacted in a stuffer box to form a yarn plug, cooling the yarn plug within a cooling zone, disentangling the yarn plug to form a crimped yarn downstream of the cooling zone, and wherein the advancing step includes a first step wherein the yarn is conveyed in a first conveying fluid stream at a yarn intake speed and a second step wherein the yarn is conveyed with a second conveying fluid stream into the crimping device at a yarn conveying speed which is at least the same as or greater than the intake speed.

2. The method of claim 1, wherein the intake speed is at least about 3,000 m/min.

3. The method of claim 1, wherein the first conveying fluid stream and the second conveying fluid stream are controlled independently of each other.

4. The method of claim 1, wherein for producing the first conveying fluid stream, the pressure of the conveying fluid is from at least about 2 bars to at most about 15 bars.

5. The method of claim 4, wherein for producing the second conveying fluid stream, the pressure of the conveying fluid is from at least about 1 bar to at most about 8 bars.

6. The method of claim 1, wherein the first conveying fluid stream and the second conveying fluid stream are generated by a common injector, with the first conveying fluid stream expanding in an expansion chamber after advancing the yarn, and a portion of the first conveying fluid stream being discharged upstream of the second step, so that the remaining portion of the first conveying stream forms the second conveying fluid stream.

7. The method of claim 6, wherein the portion of the conveying fluid stream that is discharged upstream of the second step is adjustable.

8. The method of claim 1, wherein the conveying fluid is hot air or overheated vapor.

9. The method of claim 1, wherein the denier of the entering yarn is at most about 300 dtex, and that the yarn has a crimp of at least about 20% and a crimp stability of at least about 65% with a tension of about 4 cN/dtex.

10. The method of claim 1, wherein the denier of the entering yarn is at most about 100 dtex, and that the yarn has a crimp of at least about 20% and a crimp stability of at least about 65% with a tension of about 4 cN/dtex.

11. The method of claim 1, wherein the second conveying fluid stream is discharged substantially by means of suction through openings in the stuffer box wall.

12. An apparatus for crimping an advancing multifilament yarn comprising a first feed nozzle which includes a yarn conveying channel which defines an inlet end and an outlet end, a second feed nozzle which includes a yarn conveying channel which defines an inlet end and an outlet end, with the first and second feed nozzles being serially arranged in the direction of the advancing yarn with the inlet end of the second feed nozzle being arranged directly opposite the outlet end of the first feed nozzle, a crimping device which includes a stuffer box arranged along an axial extension of the conveying channel of the second feed nozzle, and means for producing a first conveying fluid stream in the first feed nozzle and for producing a second conveying fluid stream in the second feed nozzle, with at least one of the first and second fluid streams being controllable independently of the other fluid stream.

13. The apparatus of claim 12, wherein the feed nozzles each have an injector which each initiates a fluid stream in the associated conveying channel, and that at least one of the injectors connects to a controllable source of pressure.

14. The apparatus of claim 12, wherein the feed nozzles are interconnected and include a common injector which introduces a fluid stream into the yarn conveying channel of the first feed nozzle, and which connects to a controllable source of pressure.

15. The apparatus of claim 12, wherein the feed nozzles are interconnected via an expansion chamber which is formed between the two conveying channels, with the outlet cross section of the conveying channel which terminates in the expansion chamber being greater than the narrowest cross section of the conveying channel of the second feed nozzle and wherein the expansion chamber connects to a controllable throttle valve.

16. The apparatus of claim 12, wherein when viewed in the direction of the advancing yarn, the conveying channel of the first feed nozzle is in the form of a Laval nozzle, which has a narrowest cross section at which the conveying fluid reaches sonic speed.

17. The apparatus of claim 12, wherein the second feed nozzle is connected to the crimping device, with the conveying channel of the second feed channel terminating in the stuffer box.

18. The apparatus of claim 17, wherein the outlet end of the conveying channel of the second feed nozzle and an inlet of the stuffer box are arranged in a vacuum chamber, with the stuffer box connecting via opening slots to the vacuum chamber, and with the vacuum chamber connecting to a controllable source of vacuum.

19. The apparatus of claim 12, wherein the crimping device is followed by a cooling drum, with the yarn plug advancing for cooling over the circumference thereof.

* * * * *